US005230297A

United States Patent [19]

Lakatos

[11] Patent Number: 5,230,297

[45] Date of Patent: Jul. 27, 1993

[54] GOLF DISTANCE MARKER

[76] Inventor: Frank C. Lakatos, 110 Northwest St., Freeburg, Ill. 62223

[21] Appl. No.: 883,300

[22] Filed: May 14, 1992

[51] Int. Cl.[5] ..... A63B 67/02; G09F 7/22

[52] U.S. Cl. ..... 116/209; 40/607; 273/176 A

[58] Field of Search ..... 116/209; 40/606, 608, 40/645, 607; 273/176 A, 32 H, 34 R; 248/156

[56] References Cited

U.S. PATENT DOCUMENTS

| | | | |
|---|---|---|---|
| D. 246,810 | 0/1977 | Genova . | |
| 2,610,548 | 9/1952 | Isenberg | 116/209 X |
| 2,660,822 | 12/1953 | Hargus | 40/607 X |
| 3,709,188 | 1/1973 | Coupar | 116/209 X |
| 4,079,530 | 3/1978 | Atherton et al. | 40/645 |
| 4,275,535 | 6/1981 | Stalzer | 116/209 X |
| 4,862,823 | 9/1989 | Hughes . | |
| 4,866,866 | 10/1989 | Rotter . | |
| 4,888,893 | 0/1989 | Jones . | |
| 4,926,785 | 5/1990 | Lamson | 116/209 |
| 5,114,149 | 5/1992 | Bailey | 116/209 X |

*Primary Examiner*—Daniel M. Yasich
*Attorney, Agent, or Firm*—Don W. Weber

[57] ABSTRACT

A golf fairway distance marker is presented which has an essentially flat rectangular lower base imbedded into the ground. The lower base has a horizontal slot such that when the base is placed in the ground, the horizontal slot is generally oriented parallel to the expected line of flight of the ball to the golf green. A flat thin sign is inserted into the horizontal slot so that the sign may be readily seen when perpendicular to the sign but provides an unobtrusive obstruction when parallel to the orientation of the sign and the central slit. The upper part of the sign may be color-coded red, white or blue according to the distance between the distance marker and the golf green.

3 Claims, 3 Drawing Sheets

GOLF DISTANCE MARKER

BACKGROUND OF THE INVENTION

This invention relates to the field of signs and more particularly to the field of color-coded signs for marking distances on golf course fairways.

There have been a large variety of signs which have been patented and manufactured throughout the history of the United States. These signs come in all shapes and sizes and are attached to the ground or otherwise supported in various ways. In the particular field involving signs for golf courses, a number of decorative signs have been patented in the past and near history.

One such series of patented signs for golf courses were patented in the 1970s by Peter J. Genova. An example of a Genova patented fairway map and yard marker is found in the 1977 design patent issued to Genova numbered D246,810. This sign, of course, was designed to be permanent and to be situated near the tee of a golf hole. Also of note is U.S. Pat. No. 4,862,823, a bendable marker for a golf course.

Other signs, not in the golfing field, have been put in the marketplace. One such sign, U.S. Pat. No. 4,888,893, utilizes a horizontal stand for a base and a vertical sign portion attached to the horizontal stand to signal when a motorist is in distress. A "For Sale" sign, which is collapsible and uses a U-shaped tubular frame, was disclosed in U.S. Pat. No. 4,866,866 issued to Ratter.

All of the signs previously disclosed fail to solve the unique problems encountered when placing a sign or distance marker on the fairway of a golf course. Since the sign on a golf course must be visible, yet be designed so that it would not obstruct the flight of the ball in nearly all instances, the use of the standard type of signs normally found in the industry is not possible.

In order to produce a sign which is highly visible yet poses the least obstruction to the path of a struck ball, certain design features need to be incorporated into the basic concept. The sign should also have features which allow easy maintenance, for example, the removal of grass from the immediate area of the sign. All of these unique problems are solved with the instant invention.

It is an object of this invention to provide a visible yet unobtrusive sign which can denote the distance from the position of the sign to the hole on a golf course. It is another object of this invention to provide such a sign that will stay oriented in the least obtrusive position. It is a still further object of this invention to provide an unobtrusive sign which is also readily maintained with respect to the mowing operation normally conducted on a golf course. Other and further objects of this invention will become apparent upon reading the following Specification.

BRIEF DESCRIPTION OF THE PREFERRED EMBODIMENT

This particular golf distance marker sign comprises essentially two main parts. The bottom portion, or base, comprises an essentially rectangular flat base having a rectangular cross section. This flat base is placed in the ground so that the flat top surface of the base is essentially level with the ground. The flat base has a straight slot through the base with the slot being essentially parallel to the sides of the base. Into this slot is inserted the flat vertical sign portion of the device. The sign portion of the device has an upper portion containing the message to be placed on the sign and a lower portion which is inserted into the slot in the base. When the base is sunken into the ground such that the straight slot is parallel to an imaginary line between the tee and the hole, the upper flat sign portion is aligned in a direction essentially parallel to the imaginary line so that the obstruction created by the sign is merely the width of the flat upper vertical portion. A retaining pin, located at the protruding end of the vertical sign underneath the base, holds the sign in place and protects it from theft or vandalism.

DETAILED DESCRIPTION OF THE PREFERRED EMBODIMENT

This device comprises essentially a lower base portion 1 and an upper sign portion 2. The upper sign portion 2 is above the ground while the lower base portion 1 is inserted into the ground.

Figures 2, 3, 4:
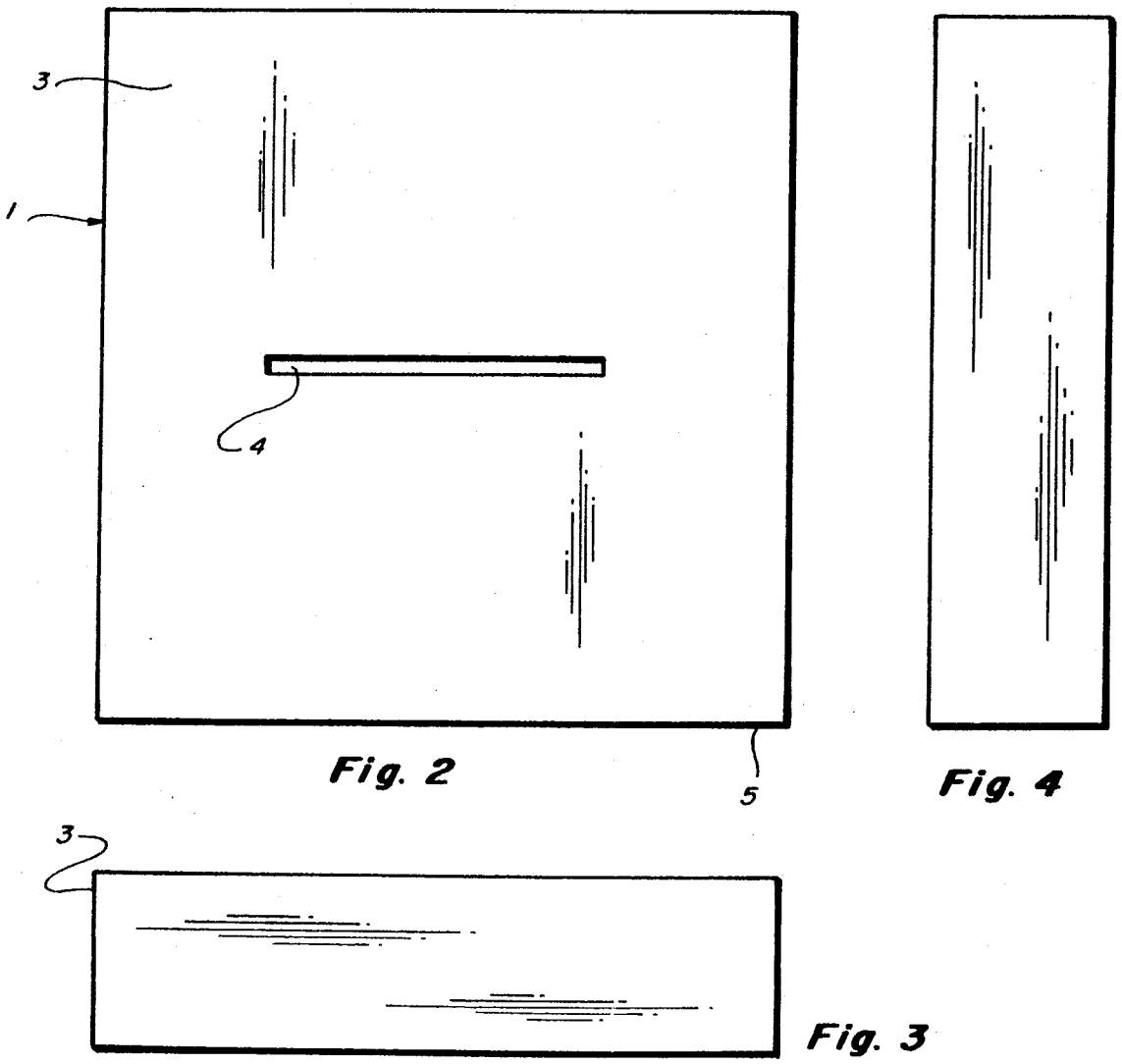
FIG. 2 is a top view of the lower base portion.
FIG. 3 is a front view of the lower base portion.
FIG. 4 is a side view of the lower base portion.

Turning to FIG. 2, the lower base portion 1 has an upper surface 3. The base portion 1 has an essentially rectangular cross section as shown in FIG. 3. The lower base portion 1 also has an essentially rectangular cross section as shown in FIG. 4. Near the center of the lower base portion 1 is a straight horizontal slot 4, as best shown in FIG. 2. This central horizontal slot 4 is arranged so that the length of the slot is parallel to the front side of the lower base portion. The central horizontal slot 4 is wide enough to receive the lower portion of the upper vertical sign. The slot is cut completely through the lower base portion 1.

Figure 1:
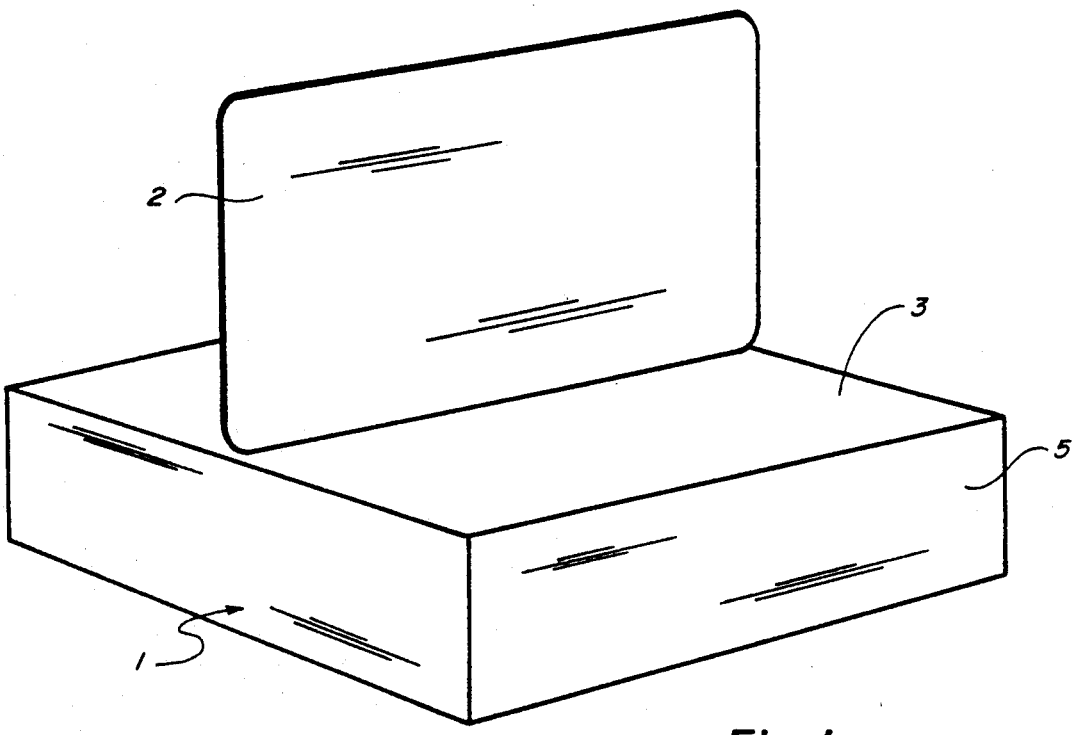
FIG. 1 is a perspective view of the upper vertical sign and lower base shown outside of the ground.
Figure 5:
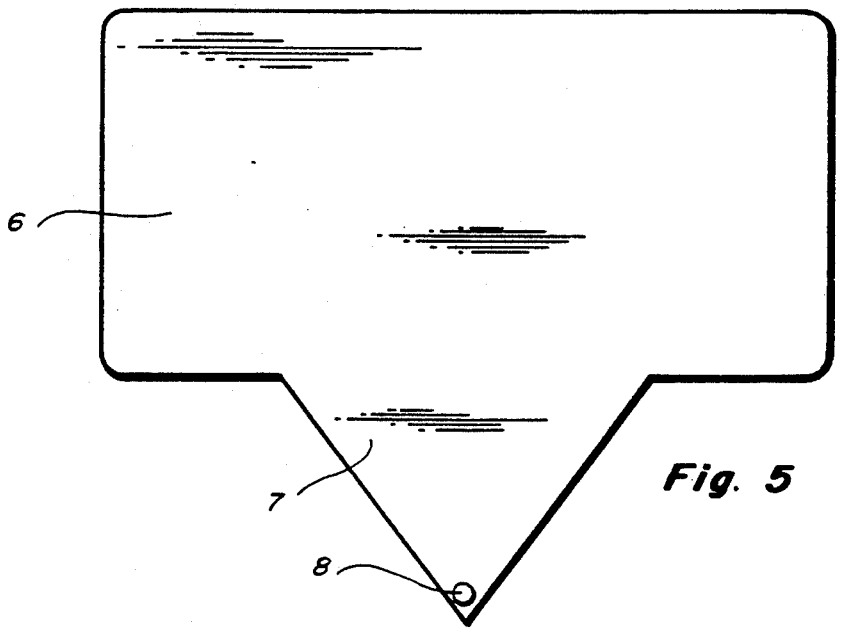
FIG. 5 is a side view of the upper vertical sign, showing the information portion and the lower securing portion.

The upper sign portion has an irregular shape essentially as shown in FIG. 5. The upper sign portion 2 is quite narrow and flat and comprises an upper flat visible informational portion 6 and lower flat fastening portion 7. A small hole 8 is drilled through the lower fastening portion 7 for securing the upper sign portion 2 to the base.

Figure 6:
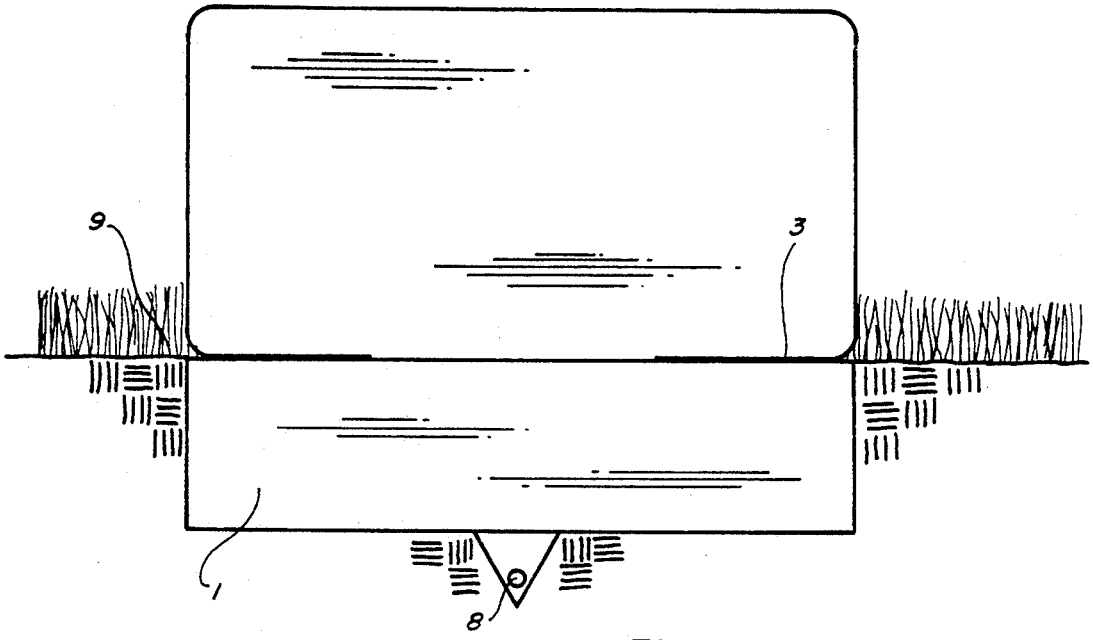
FIG. 6 is a side view of the sign shown placed in the ground, in cross section with the ground.

As shown in FIG. 6, the lower base portion 1 is inserted into an essentially rectangular hole in the ground on the golf course such that the upper surface of the base 3 is basically parallel to the ground level 9. Once the base is inserted into the ground, as shown in FIG. 6, the upper flat visible informational portion 6 of the device may be placed in a fixed location and orientation by inserting the lower flat fastening portion 7 into the slot 4 of the lower base. Since the slot 4 is parallel to the front of the lower base and since the sign is narrow and flat, the sign will only fit into the base in one fixed orientation depending upon the orientation of the lower base 1. As shown in FIG. 6, the descriptive matter written on the upper visible information portion 6 of the sign is readily observable from the position which is perpendicular to the orientation of the central horizontal slit 4.

Figure 7:
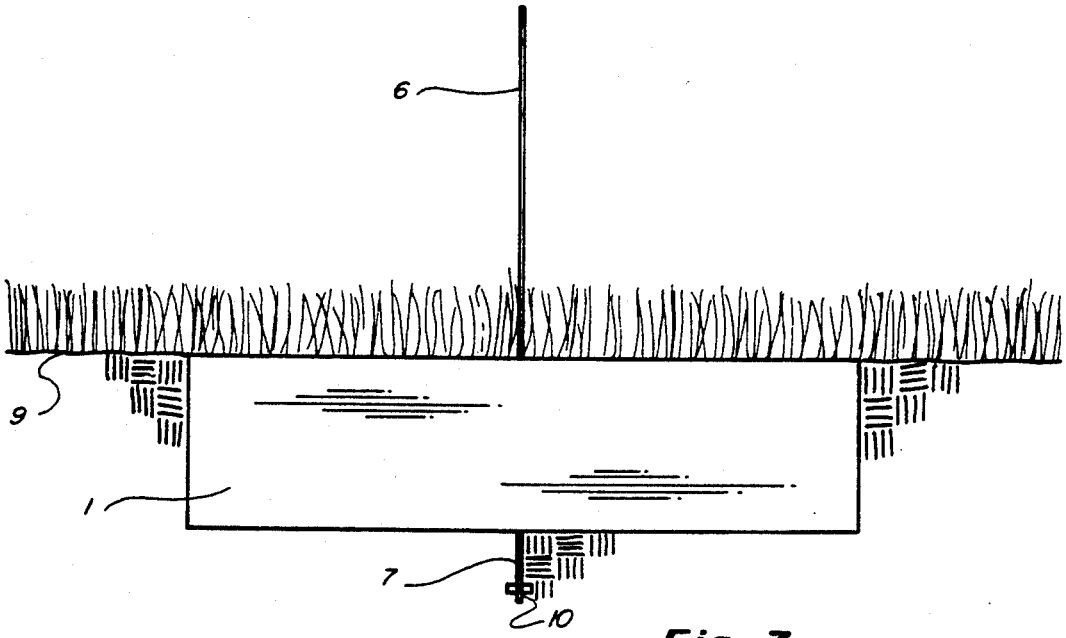
FIG. 7 is a front view of the sign with the sign in place in the ground, showing the sign located parallel to the point between the tee and the hole.

When the golf distance marker is viewed from the orientation as shown in FIG. 7, the flat narrow upper visible informational portion of the sign provides a very small obstruction to the expected flight path of the golf ball between the tee or other area on the fairway and the golf hole.

Also as shown on FIG. 7, a lower securing pin 10 may be inserted through the lower securing hole 8 so that the sign may not be removed without lifting up the lower base portion 1. This lower securing pin 10 serves to make it very difficult for a vandal to steal the sign or otherwise switch or remove the sign.

According to the Professional Golfing Association Rules, fairway markers are color-coded to disclose the distance from the marker to the hole. A red sign shows that the marker is approximately 100 yards from the center of the green while a white sign shows that the marker is approximately 150 yards from the center of the green. A blue sign shows that the marker is approximately 200 yards from the center of the green. Most of the ground level fairway markers now in existence are completely flat and parallel to the ground and are often difficult to see. Above ground fairway markers are usually inserted into the ground as a permanent fixture. The instant golf distance marker has a removable and changeable sign portion.

The orientation of the lower central horizontal slot 4 may be varied depending upon the location on the fairway at which the marker is placed. If the horizontal slot 4 is oriented so that its direction is essentially parallel to the expected line of flight of the ball to the hole on the green, then the upper informational sign portion 6 will be quite visible and readable to the golfer while it will be in the least obtrusive orientation with respect to the line of flight or roll of the ball.

The slot 4 can be rectangular in cross section or, in the preferred embodiment will be tapered, having a wide portion near the top surface of the base 3 and a narrower cross section near the bottom of the base. This configuration of the slot 4 would accommodate the tapered lower fastening portion 7.

Studies have shown that a considerable amount of time consumed during the golf game is consumed by trying to locate fairway markers. These markers are often difficult to locate since they are flush with the ground to avoid the problems of mowing the fairway with a number of artificial markers protruding above the ground surface.

One particular advantage of this particular golf distance marker is that the flat upper surface portion 3 of the base 1, as best shown on FIG. 2, would not allow for the growth of any grass on the surface. This means that a fairway mower could easily cut the grass near the sign by simply running the cutter in a direction parallel to the sign, as best shown in FIG. 7. The entire upper surface 3 of the fairway marker 1 would be free of grass and the edges about the perimeter of the base could be easily cut as described above.

These markers could be easily color-coded according to the PGA Rules as stated above and could contain a number of different signs for advertisers. Since the signs are removable, different advertisers could be accommodated on different holes or at different times of the year.

Having fully described my invention, I claim:

1. A golf distance fairway marker, of the type color-coded for distance from said marker to the center of a green with red, white and blue signs being 100, 150 and 200 yards in distance, respectively, comprising:

(a) a lower base portion having a flat upper surface essentially parallel to the ground and having a tapered central horizontal slot tapered from top to bottom therethrough;

(b) an upper sign portion comprising an upper flat informational portion and a lower flat fastening portion wherein said lower fastening portion of the sign portion is correspondingly tapered from top to bottom, said lower fastening portion being inserted into said central slot;

wherein said lower fastening portion has a securing hole at the bottom therein;

further comprising a securing pin adapted to fit into said securing hole.

2. A golf distance fairway marker as in claim 1, wherein the central horizontal slot is oriented such that said slot is parallel to the expected line of flight of a golf ball to the golf green.

3. A golf distance fairway marker as in claim 1, wherein the upper informational portion of the sign is color-coded red, white or blue according to PGA color-coded guidelines, to indicate that the distance from the sign to center of the green is 100, 150 or 200 yards, respectively.

* * * * *